US009188094B2

(12) United States Patent
Graner et al.

(10) Patent No.: US 9,188,094 B2
(45) **Date of Patent: *Nov. 17, 2015**

(54) FUEL INJECTION VALVE

(75) Inventors: Juergen Graner, Sersheim (DE); Martin Maier, Moeglingen (DE); Takuya Mizobe, Ludwigsburg (DE); Bernd Rieg, Kawasaki (JP); Volker Sohm, Yongin-si (KR); Juergen Lander, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1 day.

This patent is subject to a terminal disclaimer.

(21) Appl. No.: 13/823,610

(22) PCT Filed: Jul. 26, 2011

(86) PCT No.: PCT/EP2011/062786

§ 371 (c)(1), (2), (4) Date: Aug. 1, 2013

(87) PCT Pub. No.: WO2012/034756

PCT Pub. Date: Mar. 22, 2012

(65) Prior Publication Data

US 2013/0306762 A1 Nov. 21, 2013

(30) Foreign Application Priority Data

Sep. 16, 2010 (DE) ..... 10 2010 040 910

(51) Int. Cl.
*F02M 51/06* (2006.01)
*H01F 7/16* (2006.01)

(52) U.S. Cl.
CPC ..... *F02M 51/0614* (2013.01); *F02M 51/0682* (2013.01); *F02M 2200/08* (2013.01); *F02M 2200/9061* (2013.01); *H01F 7/1607* (2013.01)

(58) Field of Classification Search
USPC ..... 239/569–586
See application file for complete search history.

(56) References Cited

U.S. PATENT DOCUMENTS 4,662,567 A 5/1987 Knapp
5,330,153 A 7/1994 Reiter (Continued)

FOREIGN PATENT DOCUMENTS

CN 1637271 5/2001
CN 101105165 1/2008

(Continued)

OTHER PUBLICATIONS

International Search Report dated Oct. 5, 2011 in PCT/EP2011/062786, filed Jul. 26, 2011.

*Primary Examiner* — Len Tran
*Assistant Examiner* — Adam J Rogers
(74) *Attorney, Agent, or Firm* — Kenyon & Kenyon LLP

(57) ABSTRACT

A fuel injector for fuel-injection systems of internal combustion engines includes an electromagnetic actuating element having a solenoid coil, a fixed core, an outer magnetic circuit component, and a movable armature for actuating a valve-closure element, which cooperates with a valve-seat surface provided on a valve-seat element. The injector is characterized by its extremely small outer dimensions. The flexibility in the installation of fuel injectors of varying valve lengths, which is made possible very simply due to the special modular design, is significantly increased in this manner. An optimized dimensioning of the electromagnetic circuit allows for a DFR (dynamic flow range) greater than 17, the DFR being defined as the quotient of $q_{max}/q_{min}$.

10 Claims, 4 Drawing Sheets

(56) References Cited

U.S. PATENT DOCUMENTS

| | | | | |
|---|---|---|---|---|
| 6,076,802 | A | 6/2000 | Maier | |
| 6,186,472 | B1 | 2/2001 | Reiter | |
| 6,299,079 | B1 | 10/2001 | Noller et al. | |
| 6,357,676 | B1 | 3/2002 | Hanft | |
| 2006/0249601 | A1* | 11/2006 | Thoemmes | 239/585.4 |
| 2013/0256430 | A1* | 10/2013 | Terashima et al. | 239/585.5 |
| 2014/0008468 | A1* | 1/2014 | Graner et al. | 239/585.1 |
| 2014/0027545 | A1* | 1/2014 | Graner et al. | 239/585.1 |

FOREIGN PATENT DOCUMENTS

| | | | |
|---|---|---|---|
| DE | 34 45 405 | A1 | 6/1986 |
| DE | 197 39 150 | A1 | 3/1999 |
| DE | 10 2004 062191 | A1 | 8/2005 |
| EP | 0 387 179 | A2 | 9/1990 |
| EP | 1 878 908 | A2 | 1/2008 |
| JP | 7-30853 | | 4/1995 |
| JP | 11-500509 | | 1/1999 |
| JP | 2001-504916 | | 4/2001 |
| JP | 2001-509855 | | 7/2001 |
| JP | 3262793 | | 12/2001 |
| JP | 2002-518632 | | 6/2002 |
| JP | 2002-206488 | | 7/2002 |
| JP | 2001-82623 | | 10/2002 |
| JP | 2003-3934 | | 1/2003 |
| JP | 2005-207412 | | 8/2005 |
| JP | 2005-233048 | | 9/2005 |
| JP | 2008-19785 | | 1/2008 |
| JP | 4180122 | | 9/2008 |
| WO | WO 91/11605 | A2 | 8/1991 |
| WO | WO 99/66196 | | 12/1999 |

* cited by examiner

FUEL INJECTION VALVE

BACKGROUND OF THE INVENTION

1. Field of the Invention

The present invention relates to a fuel injector.

2. Description of the Related Art

A fuel injector, which includes an electromagnetic actuation element having a solenoid coil, an internal pole and an external magnetic circuit component as well as a movable valve-closure element, which cooperates with a valve seat assigned to a valve-seat body, is already known from published German patent application document DE 38 25 134 A1. The fuel injector is surrounded by a plastic extrusion coat, the plastic extrusion coat extending primarily in the axial direction so as to surround the connecting piece that acts as the inner pole as well as the solenoid coil. At least in the region surrounding the solenoid coil, ferromagnetic filler materials conducting magnetic lines of force are embedded in the plastic coating. In this respect, the filler materials surround the solenoid coil in the circumferential direction. The filler materials are fine-grained broken-up pieces of metal having soft-magnetic properties. The small metal particles embedded magnetically in the plastic have a more or less globular shape and are individually magnetically isolated and thus have no metallic contact among one another such that no effective magnetic field is formed. The positive aspect of a very high electrical resistance arising in this connection, however, is countered by an extremely high magnetic resistance, which is reflected in a substantial loss of force and thus determines the overall negative functional properties.

Furthermore, a fuel injector is known from published German patent application document DE 103 32 348 A1, which has a relatively compact design. In this valve, the magnetic circuit is formed by a solenoid coil, a fixed inner pole, a movable armature and an outer magnetic circuit component in the form of a magnetic cup. To achieve a slim and compact construction of the valve, multiple thin-walled valve sleeves are used, which act both as connection piece and as a valve-seat support and guide section for the armature. The thin-walled non-magnetic sleeve extending inside the magnetic circuit forms an air gap, via which the magnetic line of force pass over from the outer magnetic circuit component to the armature and the inner pole. A fuel injector of a comparable type of construction is shown again in FIG. 1 and is subsequently explained in more detail for a better understanding of the present invention.

Furthermore, a fuel injector is already known from published Japanese patent application document JP 2002-48031 A, which is likewise characterized by a thin-walled sleeve approach, the deep-drawn valve sleeve extending over the entire length of the valve and having a magnetic isolation point in the magnetic circuit region, in which the otherwise martensitic structure is interrupted. This non-magnetic intermediate section is situated at the level of the region of the working air gap between the armature and the inner pole and in relation to the solenoid coil so as to create a magnetic circuit that is as effective as possible. Such a magnetic isolation is also used in order to increase the DFR (dynamic flow range) compared to the known valves having conventional electromagnetic circuits. Such constructions, however, are bound up with substantial additional costs in their manufacture. Moreover, the introduction of such a magnetic isolation by a non-magnetic sleeve section results in a different geometric layout compared to valves without magnetic isolation.

BRIEF SUMMARY OF THE INVENTION

The fuel injector according to the present invention has the advantage of a particularly compact design. The valve has an extremely small outer diameter such as persons skilled in the art in the area of manifold injectors for internal combustion engines hitherto thought impossible to manufacture at the highest functionality. These very small dimensions make it possible to design the installation of the fuel injector in a much more flexible manner than was previously conceivable. Due to the modularly constructed valve, the fuel injectors according to the present invention may thus be installed in a very compatible manner in the greatest variety of receiving bores of the different vehicle manufacturers including numerous "extended tip" variants, that is, fuel injector variants of varying lengths, without changing the valve needle length or the injector sleeve length. For this purpose, the sealing ring situated on the outer magnetic circuit component and sealing against the wall of the receiving bore on the induction pipe is readily displaceable.

It is particularly advantageous that with the dimensioning of the fuel injector according to the present invention, the DFR (dynamic flow range), compared to the DFR in known fuel injectors, may also be clearly increased to >17. The great flexibility of the use of such an optimized fuel injector also becomes clear in that the valve sleeve may be implemented without a magnetic isolation, the material of the valve sleeve having a magnetic flux density B>0.3 T throughout or a zone of a reduced magnetic flux density B>0.1 T being provided in the region of the working air gap in the valve sleeve.

The new geometry of the fuel injector was advantageously defined primarily under the boundary conditions with respect to the variables $q_{min}$, $F_F$ and $F_{max}$. In order to be able to implement the extremely small outer dimensions of the magnetic circuit at full functionality, the outer diameter $D_A$ of the armature was fixed at 4.0 mm<$D_A$<5.9 mm according to the present invention.

DETAILED DESCRIPTION OF THE INVENTION

Figure 1:
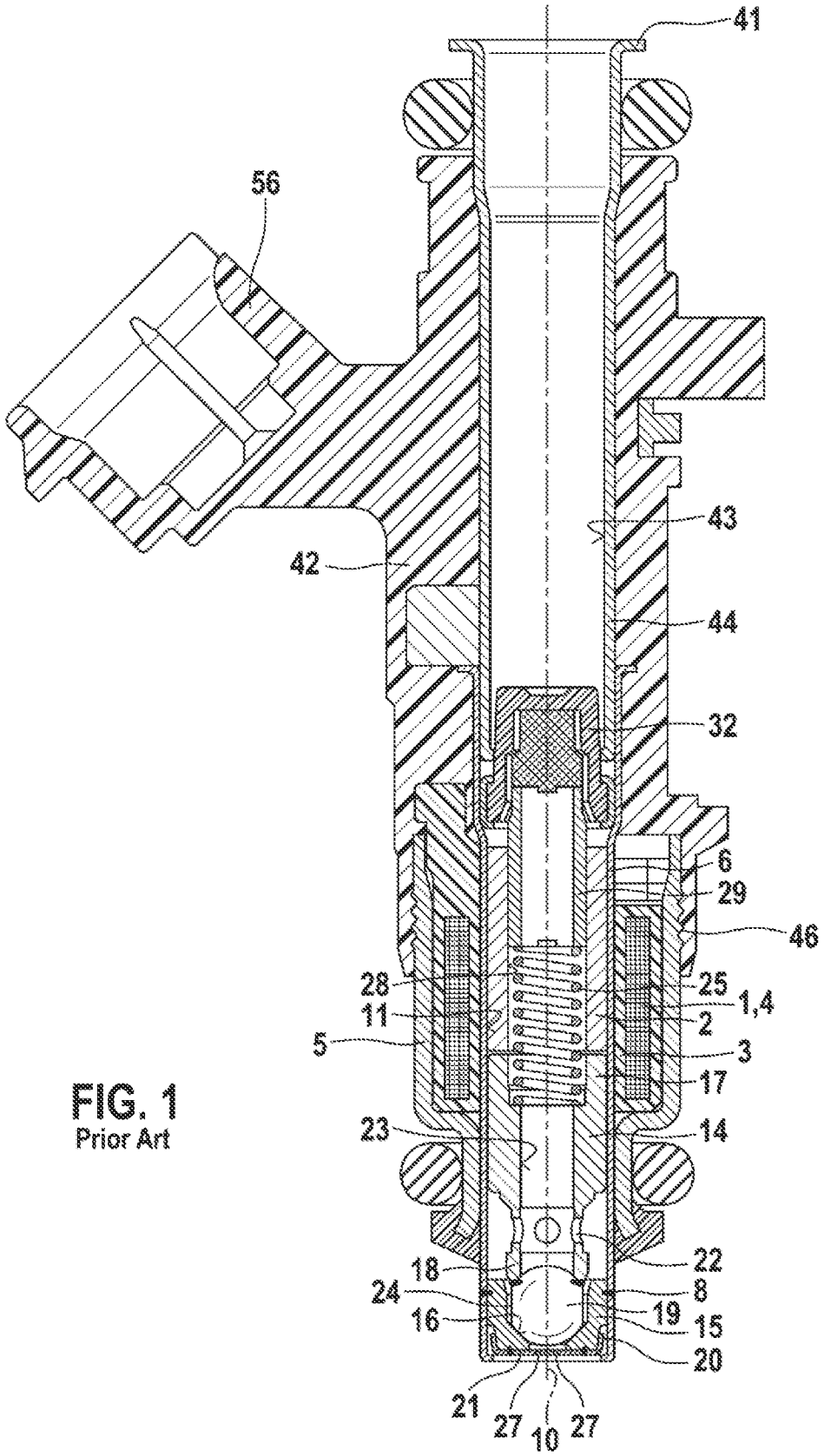
FIG. 1 Prior Art
FIG. 1 shows an electromagnetically operable valve in the form of a fuel injector according to the related art.

For a better understanding of the present invention, FIG. 1 shows in exemplary fashion an electromagnetically operable valve in the form of a fuel injector for fuel-injection systems of mixture-compressing, externally ignited internal combustion engines according to the related art.

The valve has a largely tubular core 2, which is surrounded by a solenoid coil 1 and serves as inner pole and partially as fuel passage. In the circumferential direction, solenoid coil 1 is completely surrounded by an outer, sleeve-shaped and stepped, e.g., ferromagnetic valve jacket 5, which constitutes an outer magnetic circuit component acting as external pole. Solenoid coil 1, core 2 and valve jacket 5 together form an electrically excitable actuating element.

While solenoid coil 1 having a winding 4 and being embedded in a coil shell 3 encloses a valve sleeve 6 from outside, core 2 is inserted into an inner opening 11 of valve sleeve 6 extending concentrically with respect to a longitudinal valve axis 10. Valve sleeve 6 is elongated and has thin walls. Opening 11 acts, among other things, as a guide opening for a valve needle that is axially movable along longitudinal valve axis 10. Valve sleeve 6 extends in the axial direction e.g. over approximately half of the total axial extent of the fuel injector.

In addition to core 2 and valve needle 14, a valve-seat body 15 is also disposed in opening 11, which is fastened on valve sleeve 6 e.g. by a welding seam 8. Valve-seat body 15 has a fixed valve-seat surface 16 as valve seat. Valve needle 14 is formed by, for instance, a tubular armature 17, a likewise tubular needle section 18, and a spherical valve-closure element 19, valve-closure element 19 being firmly connected to needle section 18 e.g. by a welding seam. Mounted on the downstream end face of valve-seat body 15 is an apertured spray disk 21 e.g. in the shape of a cup, whose bent and circumferentially revolving retention rim 20 is directed upward counter to the direction of flow. The firm connection of valve-seat body 15 and apertured spray disk 21 is realized e.g. by a revolving sealing welding seam. One or multiple transverse opening(s) 22 is/are provided in needle section 18 of valve needle 14 such that fuel flowing through armature 17 in an inner longitudinal bore 23 is able to exit and flow past valve-closure element 19 e.g. along flattened regions 24 up to valve-seat surface 16.

The fuel injector is actuated electromagnetically in the known manner. The electromagnetic circuit comprising solenoid coil 1, inner core 2, outer valve jacket 5, and armature 17 is used to move valve needle 14 axially and thus to open the fuel injector counter to the spring force of a restoring spring 25 that engages with valve needle 14, or to close the fuel injector. The end of armature 17 facing away from valve-closure element 19 is oriented toward core 2. Instead of core 2, it is also possible to provide e.g. a cover part, which acts as the inner pole and closes the magnetic circuit.

Spherical valve-closure element 19 cooperates with valve-seat surface 16 of valve-seat body 15, which valve-seat surface 16 is frustoconically tapered in the direction of flow and is developed in the axial direction downstream from a guide opening in valve-seat body 15. Apertured spray disk 21 has at least one, for example four spray-discharge orifice(s) 27 formed by eroding, laser drilling or stamping.

The insertion depth of core 2 in the fuel injector is decisive for, among other things, the lift of valve needle 14. When solenoid coil 1 is not excited, the one end position of valve needle 14 is defined by the abutment of valve-closure element 19 on valve seat surface 16 of valve-seat body 15, while the other end position of valve needle 14 results, when solenoid coil 1 is excited, from the abutment of armature 17 on the downstream core end. The lift is adjusted by axial displacement of core 2, which is subsequently firmly connected to valve sleeve 6 according to the desired position.

In addition to restoring spring 25, an adjustment element in the form of an adjustment sleeve 29 is inserted into a flow bore 28 of core 2, which extends concentrically with respect to longitudinal valve axis 10 and serves as conduit for the fuel in the direction of valve-seat surface 16. Adjustment sleeve 29 adjusts the prestress of restoring spring 25, which abuts against adjustment sleeve 29 and with its opposite end rests against valve needle 14 in the region of armature 17, an adjustment of the dynamic spray-discharge quantity also being performed by adjustment sleeve 29. A fuel filter 32 is disposed above adjustment sleeve 29 in valve sleeve 6.

The end of the valve on the inflow side is formed by a metal fuel inlet connection 41, which is surrounded by a plastic extrusion coat 42 which stabilizes, protects and surrounds it. A flow bore 43 of a tube 44 of fuel inlet connection 41, which runs concentrically with respect to longitudinal valve axis 10, acts as fuel inlet. Plastic extrusion coat 42 is sprayed on e.g. in such a way that the plastic directly envelops parts of valve sleeve 6 and of valve jacket 5. A secure seal is achieved via a labyrinth seal 46, for example, on the circumference of valve jacket 5. Plastic extrusion coat 42 also comprises an electric connector plug 56, which is extrusion-coated along with it.

Figure 2:
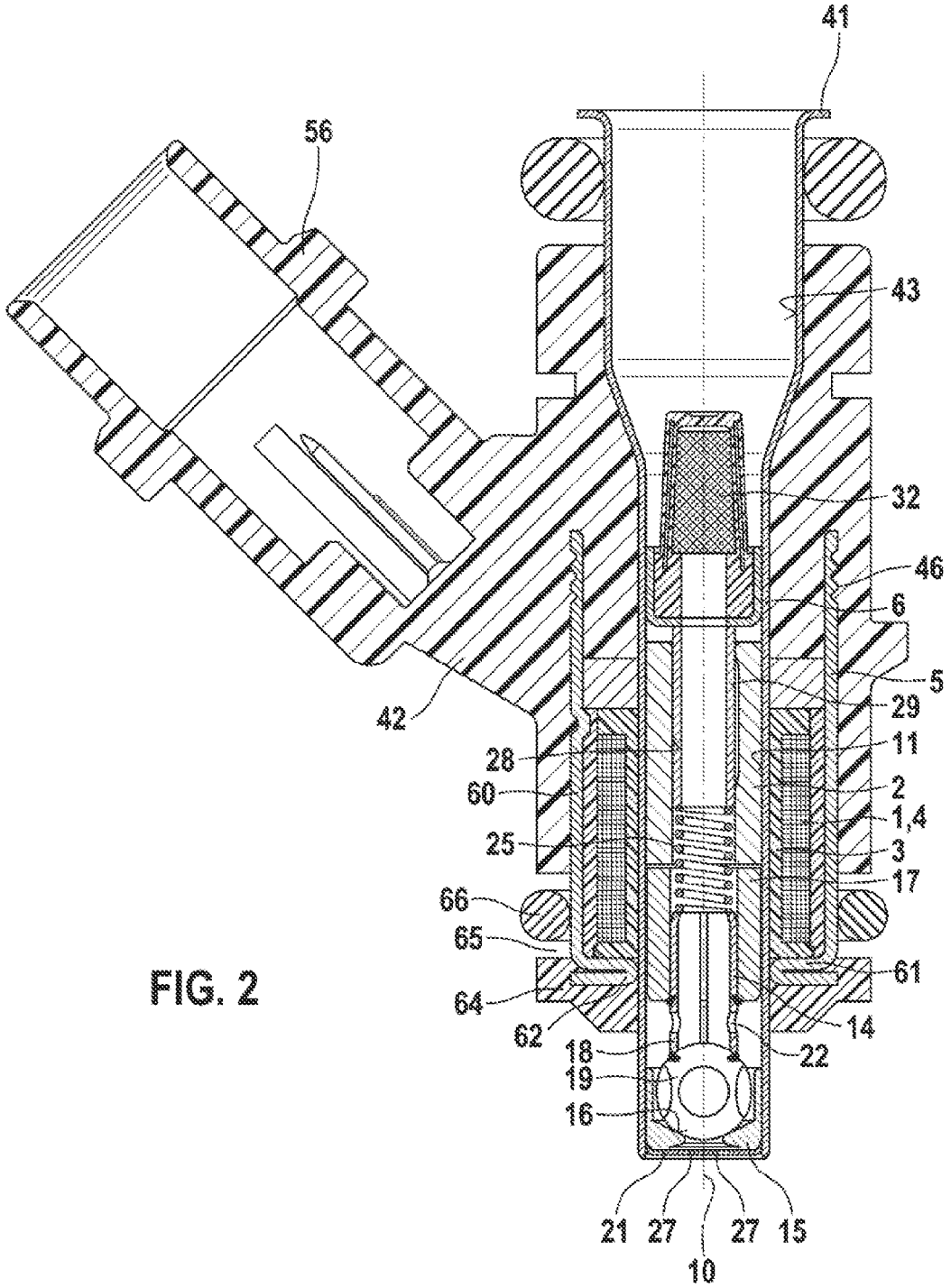
FIG. 2 shows a first embodiment of a valve according to the present invention.

FIG. 2 shows a first exemplary embodiment of a fuel injector according to the present invention. While FIGS. 1 and 2 or 3, respectively, do not immediately reveal this fact due to an incongruous scale, the fuel injectors according to the present invention are characterized by a very slim construction, a very small outer diameter and an overall extremely small geometric layout. The dimensioning according to the present invention will be explained in more detail in the following. In the present example, valve sleeve 6 is developed to extend over the entire length of the valve. Outer magnetic circuit component 5 is developed in the shape of a cup and may also be referred to as a magnetic cup. Magnetic circuit component 5 has a jacket section 60 and a bottom section 61. At the upstream end of jacket section 60 of outer magnetic circuit component 5, a labyrinth seal 46 is provided for example, by which the seal with respect to the plastic extrusion coat 42 surrounding magnetic circuit component 5 is achieved. Bottom section 61 of magnetic circuit component 5 is characterized for example by a fold 62 such that below solenoid coil 1 there is a double layer of folded magnetic circuit component 5. A support ring 64 mounted on valve sleeve 6 serves on the one hand to retain the folded bottom section 61 of magnetic circuit component 5 in a defined position. On the other hand, support ring 64 defines the lower end of an annular groove 65, into which a sealing ring 66 is inserted. The upper end of annular groove 65 is defined by a lower edge of plastic extrusion coat 42. By suitable dimensioning of the magnetic circuit, the outer diameter $D_M$ of outer magnetic circuit component 5 in the circumferential region of solenoid coil 1 measures only $10.5<D_M<13.5$ mm. Since jacket section 60 in the present embodiment of magnetic circuit component 5 runs cylindrically, magnetic circuit component 5 in no place has a greater outer diameter than an outside diameter of the aforementioned region. On the outer circumference of outer magnetic circuit component 5, sealing ring 66 is directly mounted in the region of jacket section 60 such that the fuel injector may still be inserted into receiving bores on the induction pipe of an inner diameter of 14 mm even when its sealing ring 66 is installed radially outside on the magnetic circuit. Sealing ring 66 may be provided in the circumferential region of outer magnetic circuit component 5 on the latter's greatest outer diameter.

In order to be able to implement an outer diameter of the magnetic circuit that is as small as possible, it is above all necessary to dimension the interior components such as core 2 acting as the inner pole and armature 17 to be very small. In the new dimensioning of the magnetic circuit, therefore, the minimally required size for the inner diameter of core 2 and armature 17 was defined as 2 mm. The inner diameters of the two components core 2 and armature 17 define the inner flow-through cross-section, it having been determined in this connection that at an inner diameter of 2 mm it is still possible to adjust the dynamic injection quantity using an interior restoring spring 25 without the tolerance of the inner diameter of restoring spring 25 affecting the static flow-through quantity. Various variables and parameters play an essential role in the layout of the magnetic circuit. Thus it is optimal continuously to reduce the minimum spray-discharge quantity $q_{min}$ as much as possible. In this connection, however, it must be noted that the spring force $F_F>3$ N must be maintained in order to guarantee the sealing tightness of $<1.0$ mm$^3$/min that is customary today and that will also be demanded in the future. In the present layout, at a sealing tightness diameter of d=2.8 mm, the spring force of $F_F$>3 N corresponds to the static magnetic force at a tension of $U_{min}$ of $F_{sm}$>5.5 N.

The maximum magnetic force $F_{max}$ is also an essential variable for the layout of an electromagnetically driven fuel injector. If $F_{max}$ is too small, that is, e.g. <10 N, then this may cause a so-called "closed stuck". This means that the maximum magnetic force $F_{max}$ is too small to overcome the hydraulic adhesive force between valve-closure element 19 and valve-seat surface 16. In this case, the fuel injector would not be able to open in spite of being energized.

The new geometry of the fuel injector was therefore primarily defined under the boundary conditions with respect to the variables $q_{min}$, $F_F$ and $F_{max}$. According to the present invention, it was discovered in the optimization of the geometry of the magnetic circuit that the outer diameter $D_A$ of armature 17 represents an essential variable. The optimal outer diameter of armature 17 is 4.0 mm<$D_A$<5.9 mm. From this the dimensioning of outer magnetic circuit component 5 may be derived, an outer diameter $D_M$ of magnetic circuit component 5 of 10.5 to 13.5 mm guaranteeing the full functionality of the magnetic circuit even at a markedly increased DFR (dynamic flow range) compared to known fuel injectors. Particularly advantageously, the further reduction of $q_{min}$ made possible by the special dimensioning of the magnetic circuit made it possible to achieve a DFR greater than 17. The DFR is computed as the quotient of $q_{max}/q_{min}$.

Figure 4:
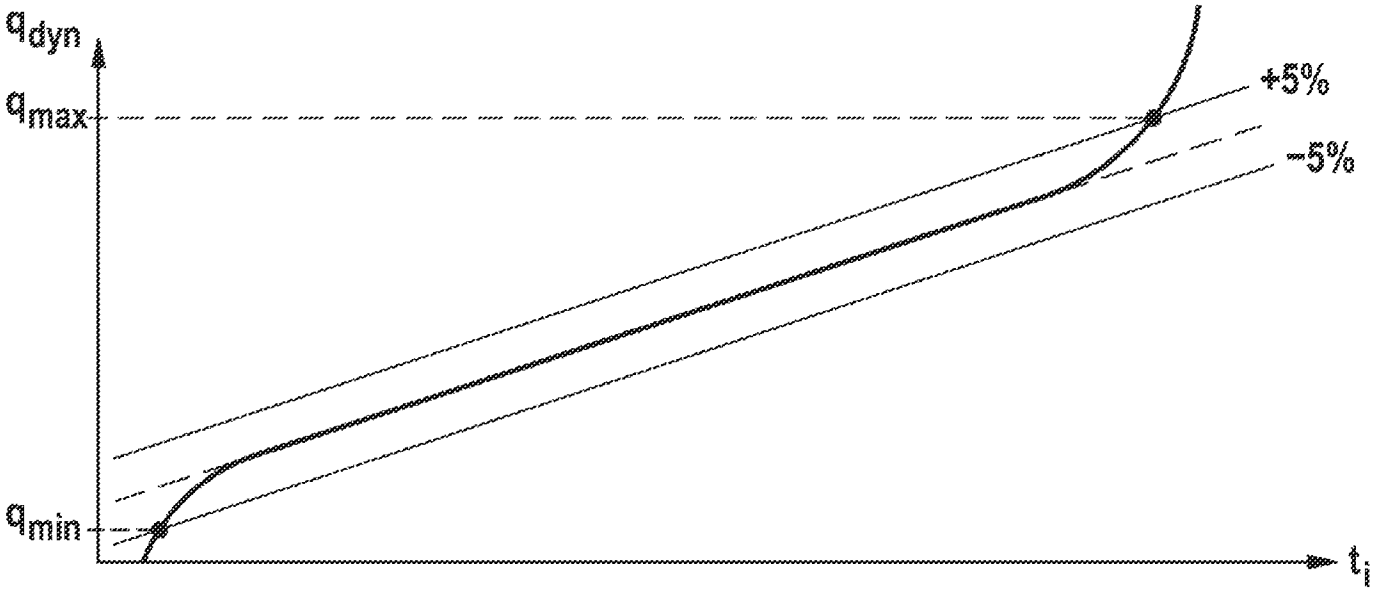
FIG. 4 shows a diagram to illustrate the determination of the DFR.

The diagram in FIG. 4 illustrates how the DFR may be determined. Via the trigger time $t_i$ of the fuel injector, multiple measuring points of the dynamic spray-discharge quantity $q_{dyn}$ are ascertained, which together yield a curve. The connected measuring points yield a curve shape that is indicated in idealized fashion in the diagram shown in FIG. 4. A line is subsequently inserted into the linear segment of the curve, which illustrates this center line as a dashed line. $q_{min}$ and $q_{max}$ are now ascertained by determining the intersections of the curve of measured values with the limits of a tolerance band of +/−5% around the linear center line. The quotient of the thus ascertained variables $q_{min}$ and $q_{max}$ in the relationship $q_{max}/q_{min}$ now indicates the DFR as the measure for the spread of the dynamic spray-discharge quantity.

In the embodiment shown in FIG. 2 having a continuous thin-walled valve sleeve 6, the optimized dimensioning provides for a wall thickness t of 0.15<t<0.35 mm for valve sleeve 6 at least in the region of the working air gap, that is, in the lower core region and in the upper armature region. In this embodiment, a zone having a magnetic flux density of B>0.1 T may be provided as a certain magnetic choke in the region of the working air gap in valve sleeve 6. Alternatively, valve sleeve 6 may be developed without a magnetic isolation or choke, which means that the material of valve sleeve 6 has a magnetic flux density B>0.3 T throughout. The development of the fuel injector in the previously described embodiment of valve sleeve 6 allows for a lift adjustment via a displacement of core 2 within valve sleeve 6.

Figure 3:
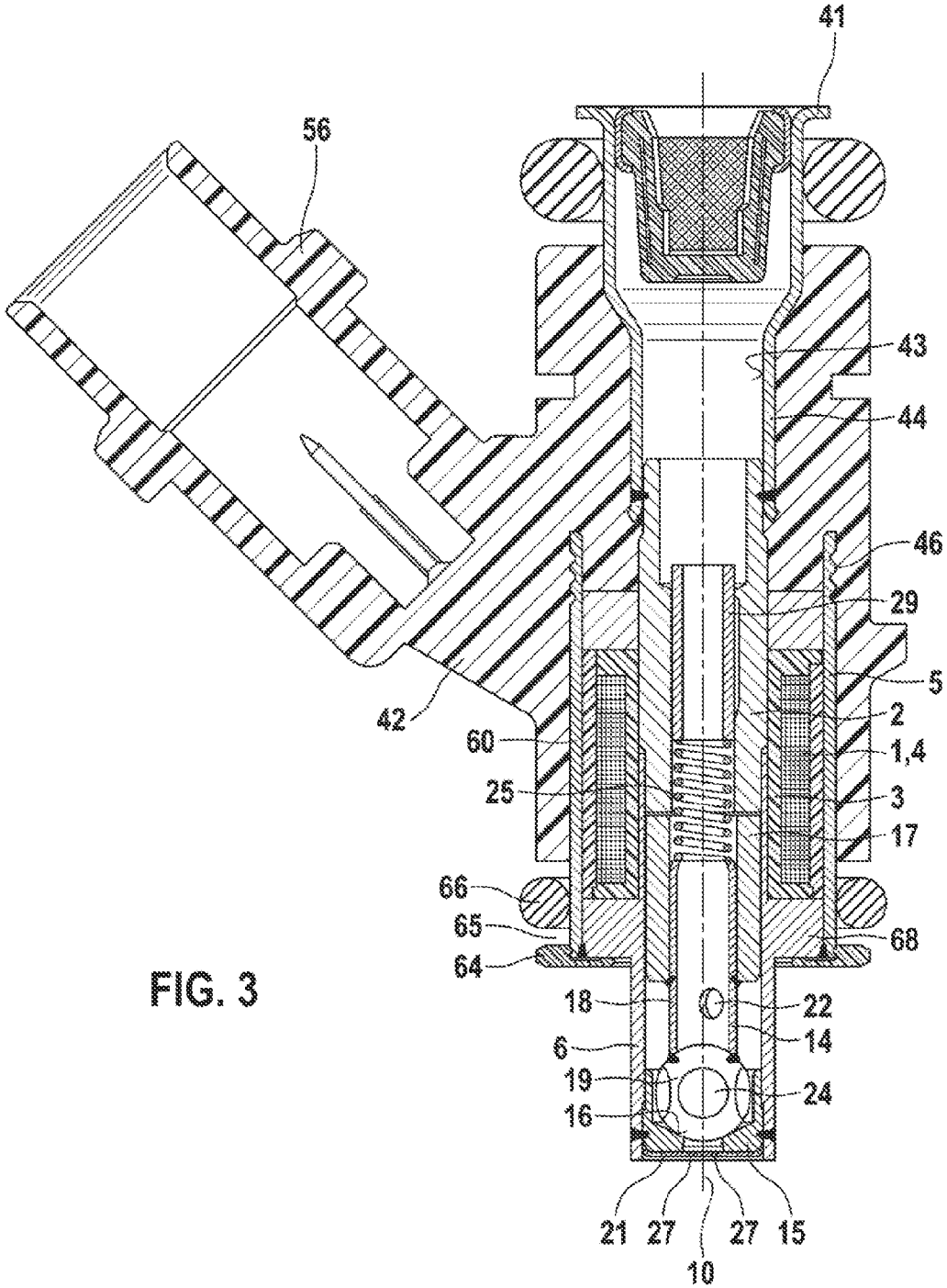
FIG. 3 shows a second embodiment of a valve according to the present invention.

The previous observations regarding geometry and dimensioning also apply analogously to a fuel injector in another embodiment as shown in FIG. 3. This fuel injector as shown in FIG. 3 differs essentially from the one shown in FIG. 2 in the region of valve sleeve 6, core 2 and outer magnetic circuit component 5. Here, valve sleeve 6 is shorter and extends from the spray-discharge side end of the valve only into the region of solenoid coil 1. Upstream from movable valve needle 14 having armature 17, valve sleeve 6 is firmly connected to pipe-shaped core 2. This means that a lift adjustment via a displacement of core 2 within valve sleeve 6 is not possible in this case. On its axially opposite end, core 2 is in turn fastened to a pipe 44 of fuel inlet connection 41 which runs concentrically with respect to longitudinal valve axis 10. In this embodiment there thus exists no thin-walled valve sleeve 6 extending over the entire length of the valve. Omitting a magnetic isolation in the region of the working air gap, valve sleeve 6 in turn may be equipped with a zone having a magnetic flux density of B>0.1 T or may be developed as a whole from a material having a magnetic flux density B>0.3 T. In the development of outer magnetic circuit component 5, a bottom section was omitted such that component 5 is tube-shaped. This is possible because valve sleeve 6 has a radially outwardly protruding flange-like collar 68, on the periphery of which magnetic circuit component 5 abuts and is fastened e.g. by a revolving welding seam. Support ring 64 is developed as a flat disk-shaped flange.

What is claimed is:

1. A fuel injector for a fuel-injection system of an internal combustion engine, the fuel injector having a longitudinal axis, comprising:

a valve unit defined by a valve-closure element and a valve seat body;

an excitable actuator in the form of an electromagnetic circuit having the following components:

a solenoid coil, an inner pole, an outer magnetic circuit component, and a movable armature, wherein the movable armature actuates the valve-closure element, which cooperates with a valve seat surface provided on the valve seat body; and a thin-walled valve sleeve which extends at least in the region of the electromagnetic circuit; wherein an outside diameter $D_M$ of the outer magnetic circuit component in a circumferential region of the solenoid coil is dimensioned to be 10.5 mm<$D_M$<13 5 mm the to achieve a DFR (dynamic flow range) greater than 17, the DFR being defined as the quotient of $q_{max}/q_{min}$, $q_{max}$ being a maximum spray-discharge quantity, and $q_{min}$ being a minimum spray-discharge quantity, and wherein the valve sleeve is implemented without magnetic isolation such that one of (i) the entire material of the valve sleeve has a magnetic flux density of B>0.3 T, or (ii) a portion having a magnetic flux density B>0.1 T is provided in a region of a working air gap in the valve sleeve.

2. The fuel injector as recited in claim 1, wherein an outer diameter $D_A$ of the movable armature is 4.0 mm<$D_A$<5.9 mm.

3. The fuel injector as recited in claim 1, wherein a wall thickness t of the valve sleeve at least in the region of the working air gap is 0.15 mm<t<0.35 mm.

4. The fuel injector as recited in claim 1, wherein a sealing ring is mounted directly on an outer circumference of the outer magnetic circuit component.

5. The fuel injector as recited in claim 4, wherein the sealing ring is provided in a circumferential region of the outer magnetic circuit component at the greatest outer diameter of the outer magnetic circuit.

6. The fuel injector as recited in claim 1, wherein the thin-walled valve sleeve extends over the entire axial length of the fuel injector, and wherein the inner pole is displaceable within the valve sleeve for adjusting a lift.

7. The fuel injector as recited in claim 1, wherein the outer magnetic circuit component has a cup-shaped configuration including a jacket section and a bottom section.

8. The fuel injector as recited in claim 7, wherein the bottom section is double-layered by folding.

9. The fuel injector as recited in claim 1, wherein the thin-walled valve sleeve extends from a spray-discharge-side end of the fuel injector into a region of the solenoid coil, and wherein the inner pole is situated immovably on the valve sleeve.

10. The fuel injector as recited in claim 9, wherein the valve sleeve has a radially outwardly protruding flange-like collar, and wherein the magnetic circuit component abuts on an outer circumference of the flange-like collar and is fastened to the outer circumference of the flange-like collar.

* * * * *